US010182664B2

(12) United States Patent
Chikkakalbalu et al.

(10) Patent No.: US 10,182,664 B2
(45) Date of Patent: Jan. 22, 2019

(54) INTEGRATED DOOR RAILS FOR DOOR CASES

(71) Applicant: Heatcraft Refrigeration Products LLC, Richardson, TX (US)

(72) Inventors: Chandrashekhara Chikkakalbalu, Columbus, GA (US); Vinod Kunchala, Chittoor (IN)

(73) Assignee: Heatcraft Refrigeration Products, LLC, Richardson, TX (US)

( * ) Notice: Subject to any disclaimer, the term of this patent is extended or adjusted under 35 U.S.C. 154(b) by 171 days.

(21) Appl. No.: 15/245,464

(22) Filed: Aug. 24, 2016

(65) Prior Publication Data

US 2018/0055247 A1 Mar. 1, 2018

(51) Int. Cl.
*A47F 3/04* (2006.01)
*E05D 7/081* (2006.01)

(52) U.S. Cl.
CPC ..... *A47F 3/0408* (2013.01); *E05D 7/081* (2013.01); *E05Y 2900/202* (2013.01); *E05Y 2900/31* (2013.01)

(58) Field of Classification Search
CPC ..... A47F 3/0408; E05Y 2900/31; E05Y 2900/202; E05D 3/02; E05D 7/081
See application file for complete search history.

(56) References Cited

U.S. PATENT DOCUMENTS 9,157,675 B2 * 10/2015 Howington ..... F25D 27/00
2006/0265979 A1 * 11/2006 Cording ..... A47F 3/0434 52/204.5
2015/0164243 A1 * 6/2015 Moody ..... A47F 3/0408 62/89

* cited by examiner

*Primary Examiner* — Ana M Vazquez
(74) *Attorney, Agent, or Firm* — Winstead PC

(57) ABSTRACT

A refrigerated enclosure system includes an enclosure with an interior region defined between a top portion and a bottom portion. A top rail is attached to the top portion and includes an upper hinge mount. A bottom rail is attached to the bottom portion and includes a lower hinge mount. A central axis of the lower hinge mount is positioned relative to a central axis of the upper hinge mount to enable a door secured to the upper hinge mount and the lower hinge mount to open and close relative to an opening of the enclosure. The refrigerated enclosure system also includes a first insulating layer positioned on a back side of the top rail and within the interior region and a second insulating layer positioned on a back side of the bottom rail and within the interior region. The first and second insulating layers inhibit a transfer of heat into the enclosure.

17 Claims, 7 Drawing Sheets

INTEGRATED DOOR RAILS FOR DOOR CASES

TECHNICAL FIELD

The present invention relates generally to refrigerated enclosure systems and more particularly, but not by way of limitation, to energy efficient refrigerated enclosure systems.

BACKGROUND

It is sometimes desirable to refrigerate goods that are for sale. For example, beverages such as milk need to be refrigerated in order to extend the milk's shelf-life. Some foods need to be frozen in order to preserve them until they are ready to be cooked. In a commercial setting, refrigerated goods are often stored in refrigerated enclosures that have transparent doors that allow the products within the refrigerated enclosure to be seen without opening the door, thereby increasing product visibility.

Compared to refrigerated enclosures without transparent doors, refrigerated enclosures with transparent doors can be more complicated to operate. For example, the refrigerated enclosures with transparent doors can sometimes have problems with condensation formation on a frame that secures the doors to the refrigerated enclosure. Condensation sometimes forms on the frame due to a temperature difference between a back side of the frame and a front side of the frame. The back side of the frame is generally exposed to the cold, refrigerated space of the refrigerated enclosure and the front side of the frame is generally exposed to warmer ambient air surrounding the refrigerated enclosure.

Condensation formation is sometimes prevented by installing heating elements into the frame to heat the frame to a temperature above a dew point. The dew point is the atmospheric temperature below which water droplets begin to condense from the air. While the use of heating elements is sometimes effective for limiting or preventing condensation, it adds complexity to the refrigerated enclosure system. For example, the use of heating elements requires the use of additional electricity to power the heating elements and decreases safety of the system because electrical components are placed in proximity to people adding or removing goods to the refrigerated enclosure. The use of heating elements also results in the frame itself becoming bulky and heavy. In some refrigerated enclosure designs, the heating elements and other electrical components are integrated into an interior of the frame. Placing the heating elements and other electrical components inside the frame makes servicing the heating elements and other electrical components extremely difficult.

SUMMARY

A refrigerated enclosure system includes an enclosure with an interior region defined between a top portion and a bottom portion. A top rail is attached to the top portion and includes an upper hinge mount. A bottom rail is attached to the bottom portion and includes a lower hinge mount. A central axis of the lower hinge mount is positioned relative to a central axis of the upper hinge mount to enable a door secured to the upper hinge mount and the lower hinge mount to open and close relative to an opening of the enclosure. The refrigerated enclosure system also includes a first insulating layer positioned on a back side of the top rail and within the interior region and a second insulating layer positioned on a back side of the bottom rail and within the interior region. The first and second insulating layers inhibit a transfer of heat into the enclosure.

A door-mounting system includes a top rail that is securable to an upper portion of a structure, such as, for example, a refrigerated enclosure. The top rail includes a first mounting face oriented downwards and a first hinge mount associated with the first mounting face. The door-mounting system also includes a bottom rail that is securable to a lower portion of the structure. The bottom rail includes a second mounting face oriented upwards towards the first mounting face and a second hinge mount associated with the second mounting face. A central axis of the second hinge mount is positioned relative to a central axis the first hinge mount to enable a door secured to the first hinge mount and the second hinge mount to pivot relative to the top rail and the bottom rail. A first insulating layer is positioned on a back side of the top rail and a second insulating layer positioned on a back side of the bottom rail. The first and second insulating layers inhibit heat transfer from an area in front of the top rail and the bottom rail to an area behind the top and the bottom rail.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

In commercial settings, refrigerated products are often displayed in refrigerated enclosures that include transparent doors that allow the refrigerated products within the refrigerated enclosure to be seen without needing to open the transparent doors. As with most refrigeration devices, power consumption and energy efficiency are considerations that impact the cost of operation. Safety is another important consideration. Furthermore, some refrigerated enclosures include transparent doors with lighting components and heating elements attached to or secured within a frame to which the transparent doors of the refrigerated enclosure are attached. In order to power the lighting components and heating elements secured within the refrigerated enclosure, it is necessary to provide electrical power to the frame. Powering the heating elements not only uses more electricity, but also adds complexity to the design of the refrigerated enclosure and further adds safety concerns. For example, running electrical power to the heating elements creates the possibility of electric shock to a user opening the door if the wiring associated with the heating elements were to fail. Securing a lighting component to the frame also adds to the possibility of electric shock to the user using the refrigerated enclosure. The exemplary systems described herein eliminate the bulky, heavy, and complicated frame of prior refrigerated enclosure systems in favor of a smaller, lighter, and simpler rail mounting system that does not require the use of heating elements. Elimination of the heating elements reduces energy consumption of the refrigerated enclosure by up to 40%. Elimination of the frame reduces the cost to manufacture the refrigerated enclosure by up to 50%.

Figure 1:
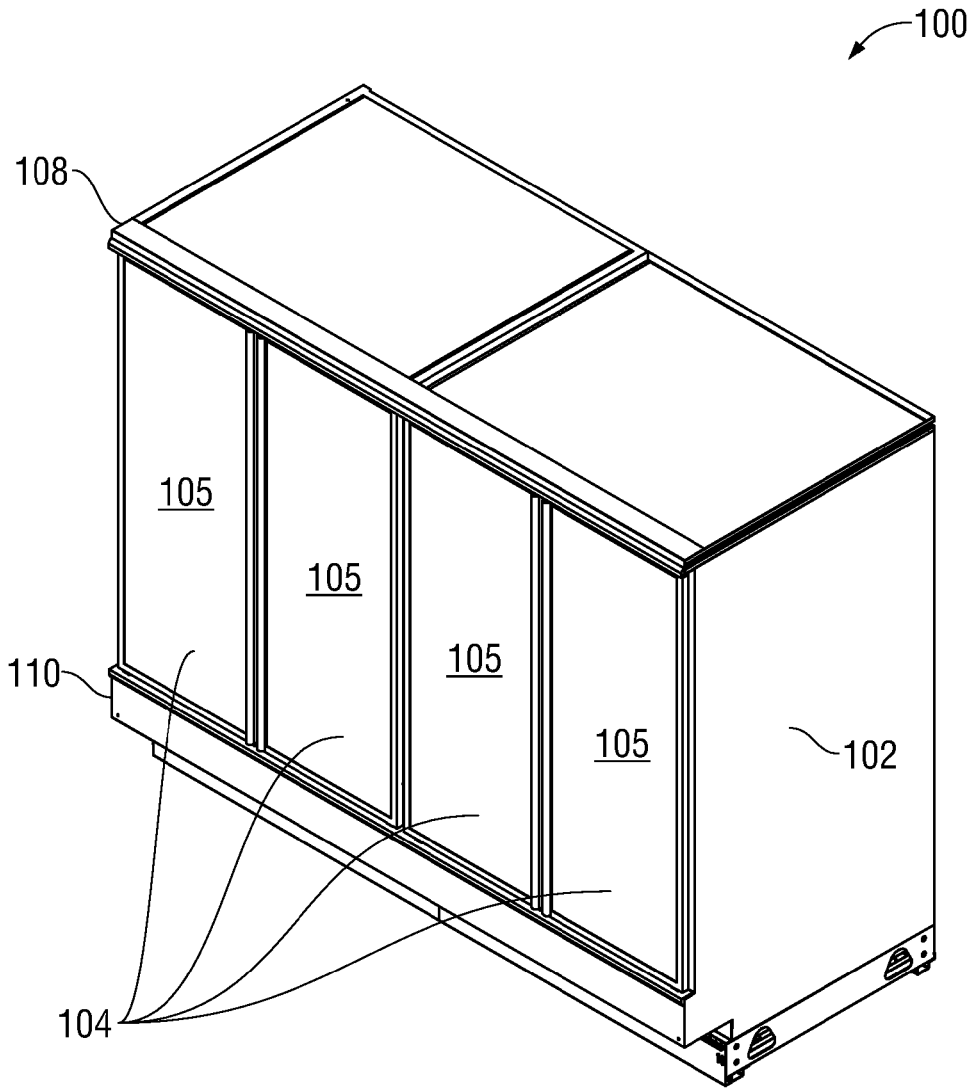
FIG. 1 illustrates an exemplary refrigerated enclosure system.

FIG. 1 illustrates an exemplary refrigerated enclosure system 100. The system 100 includes an enclosure 102 and a plurality of doors 104 secured to the enclosure 102. The enclosure 102 defines an interior region that can be refrigerated. In a typical embodiment, the refrigerated space is adapted to accommodate one or more shelves upon which various products can be stored and displayed. Dimensions of the enclosure 102 may be varied as desired. In the embodiment shown in FIG. 1, the enclosure 102 is sized to accommodate four doors 104. In other embodiments, more or fewer doors 104 may be included as desired. In some embodiments, multiple systems 100 may be placed adjacent to one another to provide additional capacity as needed. The plurality of doors 104 are secured to the enclosure 102 via a top rail 108 and a bottom rail 110, each of which is secured to the enclosure 102. The design of the top rail 108 and bottom rail 110 of the system 100 is such that the frame and heating elements discussed above are eliminated. The top rail 108 and the bottom rail 110 will be discussed in more detail below with respect to FIGS. 2A-2E.

In a typical embodiment, each of the plurality of doors 104 includes a transparent panel 105 and is thermally insulated from the enclosure 102. In a typical embodiment, the transparent panel 105 is made from various materials such as, for example, glass, acrylic, and the like. In some embodiments, the plurality of doors 104 may be removed from the system 100 to convert the system 100 into a doorless, open system. The open system may include, for example, a cold-air vent that directs cold air from an upper area of the enclosure 102 towards a lower area of the enclosure 102.

Figure 2A:
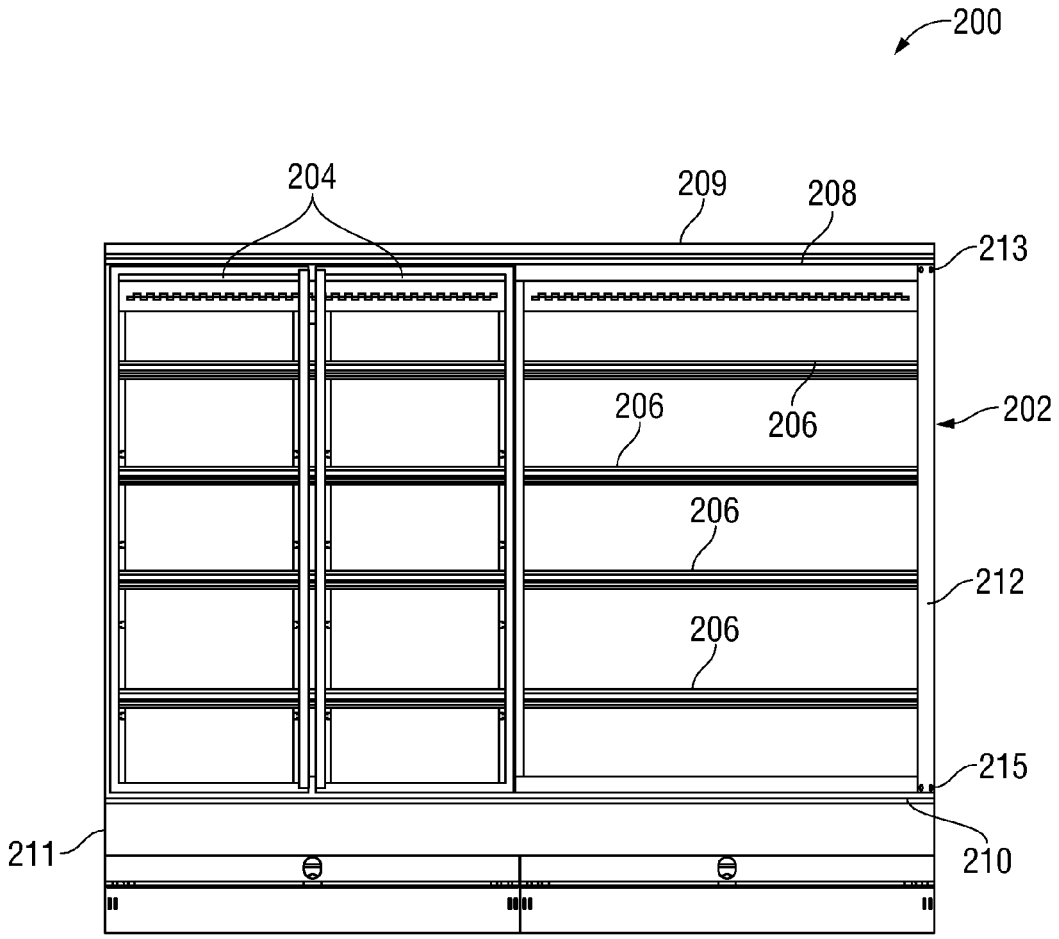
FIG. 2A is a front view of an exemplary refrigerated enclosure system.
Figure 2B:
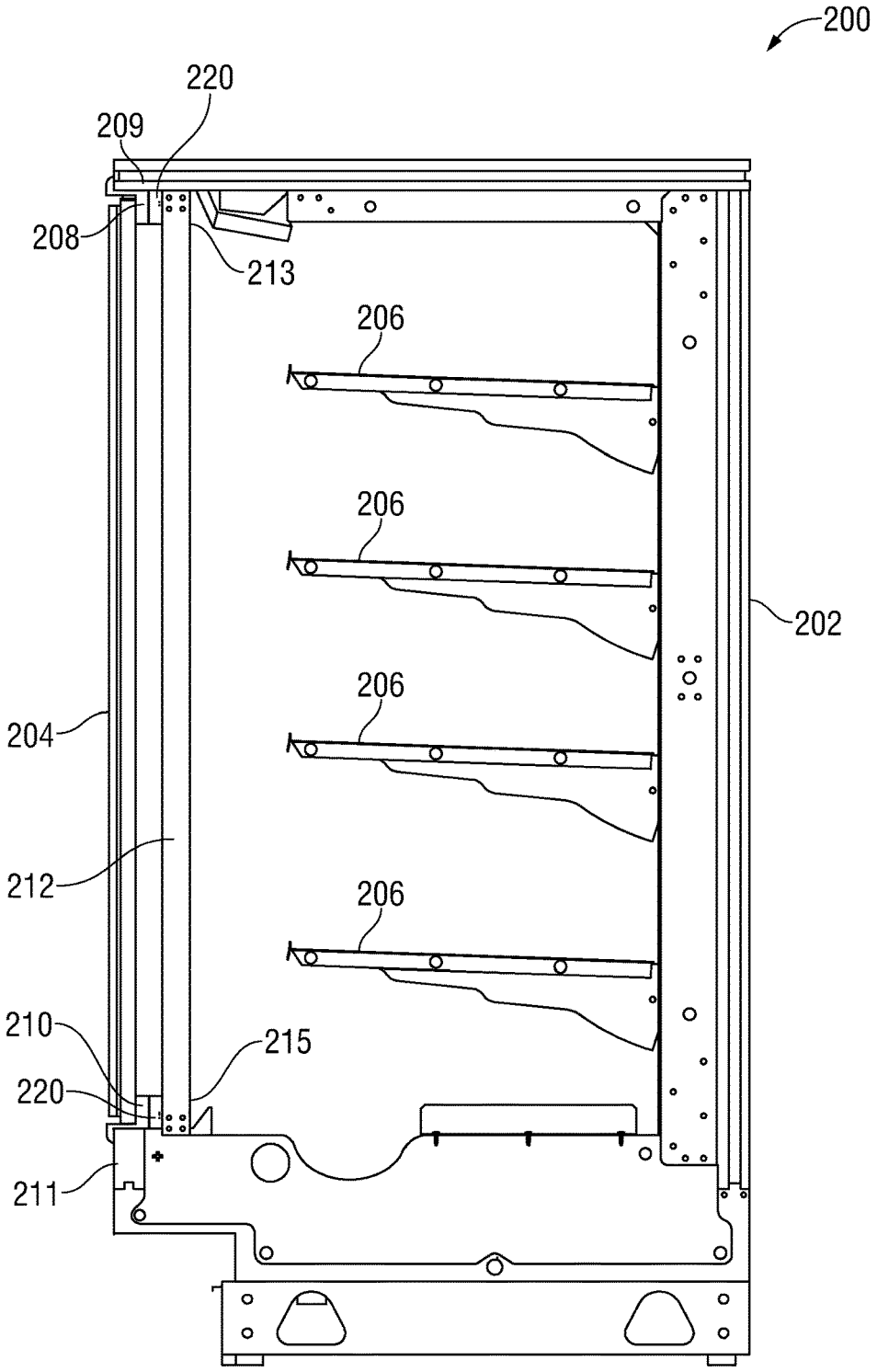
FIG. 2B is a side view of the exemplary refrigerated enclosure system.

FIGS. 2A and 2B illustrate front and side views, respectively, of an exemplary refrigerated enclosure system 200. The system 200 is similar to the system 100 of FIG. 1 and includes an enclosure 202 and a plurality of doors 204 secured to the enclosure 202. For illustration purposes, two doors 204 and a side panel have been removed so that an inside of the enclosure 202 can be seen. In a typical embodiment, the enclosure 202 includes at least one shelf 206 that is adapted to store and display products. The number of shelves 206 and the spacing between the shelves 206 may be changed as desired. Each of the plurality of doors 204 is secured to a top rail 208 and a bottom rail 210 via a hinge mount 218 (best seen in FIGS. 2D and 2E). In a typical embodiment, each of the plurality of doors 204 is thermally insulated from the enclosure 202.

In a typical embodiment, the top rail 208 is secured to a top portion of a structure and the bottom rail 210 is secured to a bottom portion of the structure. The structure may be any of a variety of enclosures such as, for example, the enclosure 202. As shown in FIGS. 2A and 2B, the top rail 208 is secured to a top portion 209 of the enclosure 202 and the bottom rail 210 is secured to a bottom portion 211 of the enclosure 202. In a typical embodiment, a vertical support 212 is connected at a first end 213 to the top portion 209 and at a second end 215 to the bottom portion 211. In contrast to the bulky frame of prior refrigerated enclosure systems, the vertical support 212 is mounted inside of the enclosure 202. Because the vertical support 212 is mounted inside the enclosure 202, the vertical support 212 maintains a similar temperature to the inside of the enclosure 202 and no condensation forms on the surface of the vertical support 212 during normal operation. In a typical embodiment, the vertical support 212 provides extra stability for the enclosure 202. In some embodiments, the vertical support 212 is only secured to the top portion 209 and the bottom portion 211. In other embodiments, the vertical support 212 is also secured to the top rail 208 and the bottom rail 210. In other embodiments, the vertical support 212 is only secured to the top rail 208 and the bottom rail 210. In some embodiments, the vertical support 212 may also serve as a mounting point for shelf support or for one or more lighting components.

Figure 2C:
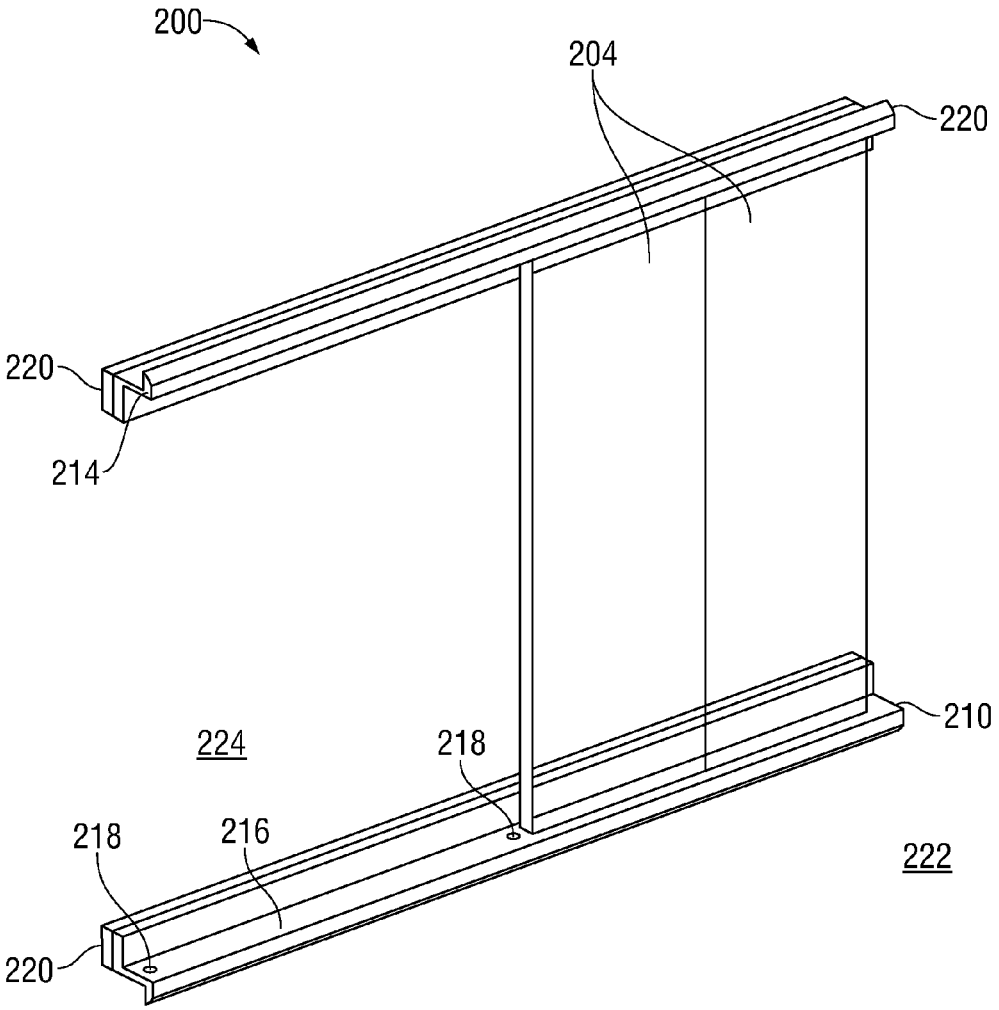
FIG. 2C is a partial assembly of the exemplary refrigerated enclosure system.

FIG. 2C is a partial assembly of the exemplary refrigerated enclosure system 200. For illustrative purposes, FIG. 2C will be described herein relative to FIGS. 2A and 2B. FIG. 2C illustrates two doors 204 installed between the top rail 208 and the bottom rail 210. The remaining components of the system 200 have been hidden. The top rail 208 includes a top mounting face 214 (see also FIG. 2D) that faces generally down towards a bottom mounting face 216 (see also FIG. 2E) of the bottom rail 210. In a typical embodiment, each of the mounting faces 214 and 216 includes a plurality of hinge mounts 218. Each of the plurality of hinge mounts 218 may be a recess or hole formed through the mounting faces 214 and 216 or may be a boss secured to the mounting faces 214 and 216. For example, the hinge mounts 218 may be formed into the mounting faces 214 and 216, screwed into the mounting faces 214 and 216, welded to the mounting faces 214 and 216, and the like. In a typical embodiment, each of the hinge mounts 218 is adapted to receive a structure, such as, for example, a pin 226 or pin 227 (best seen in FIGS. 2D and 2E, respectively), from the door 204 to secure the door 204 to the system 200 while allowing the door 204 to open and close. The hinge mounts 218 of the top rail 208 cannot be seen in FIG. 2C; however, each of the hinge mounts 218 of the top rail 208 are positioned to be directly above a central axis of each of the hinge mounts 218 of the bottom rail 210 so that an axis of rotation for each of the plurality of doors 204 is defined.

The top rail 208 and the bottom rail 210 each include a font side that is positioned near an outside region 222 of the enclosure 202 and a back side that is positioned near an interior region 224 of the enclosure 202. In a typical embodiment, the interior region 224 of the enclosure 202 is refrigerated and is colder than the outside region 222 of the enclosure 202. Because the top rail 208 and the bottom rail 210 are continuous pieces, a temperature differential exists between front and back sides of each of the top rail 208 and the bottom rail 210. In order to reduce the amount of heat transferred into the interior region 224, the top rail 208 and the bottom rail 210 can be fitted with, for example, an insulating layer 220. In a typical embodiment, the insulating layer 220 acts as a layer of insulation that reduces or inhibits heat transfer between the top rail 208 and the bottom rail 210, respectively, with the interior region 224. In a typical embodiment, the insulating layer 220 is made of expanded PVC insulation. In other embodiments, other insulating materials may be used. In typical embodiment, insulation materials with a U-Value of approximately 0.460 BTU/(hr-ft$^2$-° F.) or lower are used. The U-value is a measure of how much heat is lost through a given thickness of a particular material. Insulating the top rail 208 and the bottom rail 210 helps prevent temperatures of the front sides of the top rail 208 and the bottom rail 210 from reaching the dew-point temperature, thus reducing an amount of condensation formed on surfaces of the top rail 208 and the bottom rail 210.

Figure 2D:
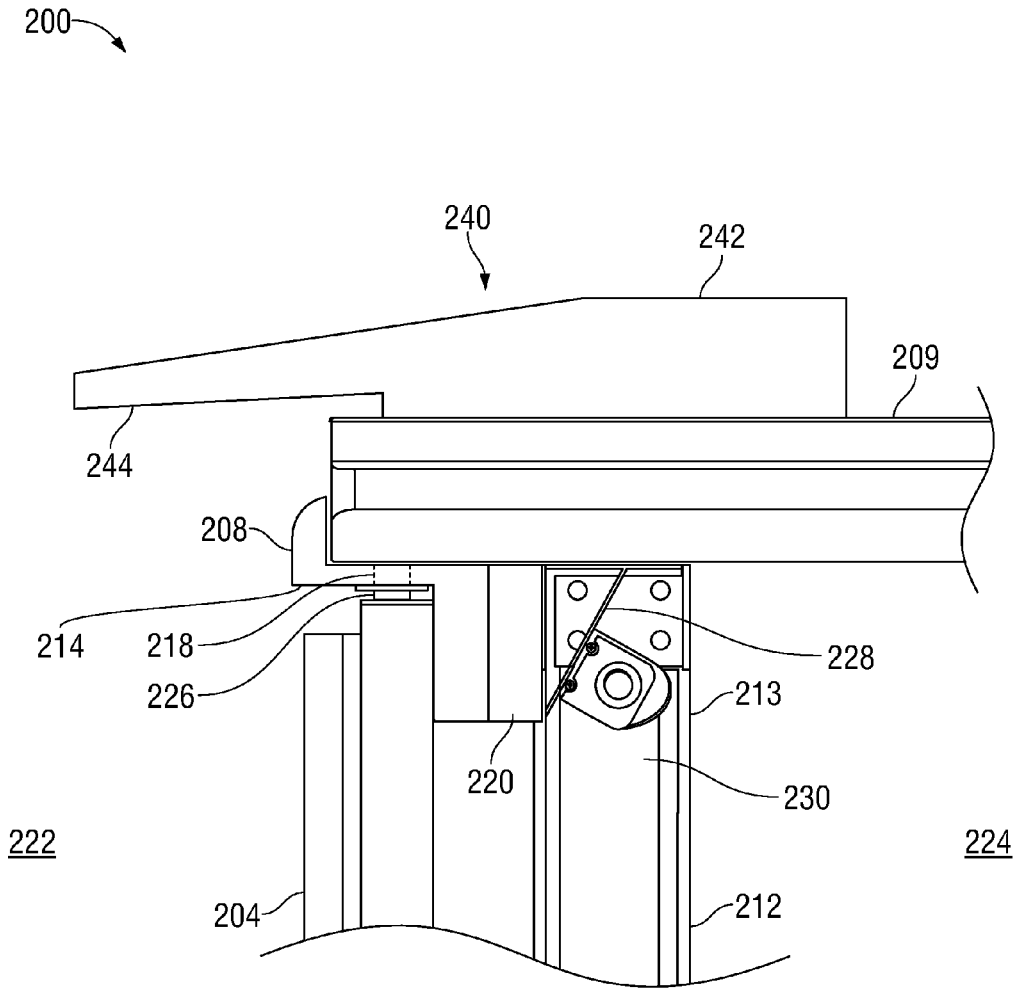
FIG. 2D is a close-up view of a top rail of the exemplary refrigerated enclosure system of FIG. 2B.

FIG. 2D is a close-up view of the top rail 208 of the exemplary refrigerated enclosure system 200 of FIG. 2B. For illustrative purposes, FIG. 2D will be described herein relative to FIG. 2B. The top rail 208 is illustrated as being attached to an under side of the top portion 209. The door 204 is illustrated as being secured to the top rail 208 via a pin 226 that is inserted into the hinge mount 218. The vertical support 212 is shown secured within the interior region 224 of the enclosure 202. Because the vertical support 212 is completely within the interior region 224, there is no concern that the temperature of the vertical support 212 will reach the dew point temperature. Thus, no condensation will form on the vertical support 212.

In a typical embodiment, the system 200 includes a bracket 228 that is adapted to have a lighting system 230 secured thereto. In a typical embodiment, the bracket 228 extends along an entire length of the top rail 208. The lighting system 230 is adapted to illuminate products within the enclosure 202. In a typical embodiment, the lighting system 230 extends along an entire length of the top rail 208. In other embodiments, the lighting system 230 may include multiple separate lighting components that are secured to the bracket 228. Because the lighting system 230 is secured to the bracket 228 and not within a frame, the lighting system 230 is easily accessible for servicing and replacement. In some embodiments, the lighting system 230 may include additional lighting components that are secured to other portions of the system 200. For example, lighting components may be secured to the vertical supports 212 (e.g., see FIG. 2F), the bottom rail 210, one or more of the plurality of shelves 206, or other components of the system 200. When securing the lighting system 230 to the bottom rail 210, a bracket, similar to the bracket 228, may be secured to the back side of the bottom rail 210. In a typical embodiment, lights of the lighting system 230 are positioned close to the door 204 and are oriented towards the shelves 206 to illuminate the products stored thereon.

FIG. 2D includes an optional cold-air vent system 240 that extends across a width of the enclosure 202 along the top portion 209. The cold-air vent system 240 includes a header portion 242 that is adapted to receive cold air from the interior region 224. The cold air is communicated from the header portion 242 to a vent 244 that directs the cold air down towards the plurality of doors 204. The vent 244 is positioned so that cold air is vented toward an area in proximity to the plurality of doors 204. Providing cold air to the area in front of the enclosure 202 helps reduce any temperature differential between an outside surface of the plurality of doors 204 and an inside surface of the plurality of doors 204, thereby reducing the likelihood of condensation forming on the doors. In a typical embodiment, the cold-air vent system 240 is adapted to vent refrigerated air from the area 224, but in other embodiments the cold-air vent system 240 could be adapted to collect cold air for a secondary cold-air source such as, for example, a dedicated refrigeration system.

Figure 2E:
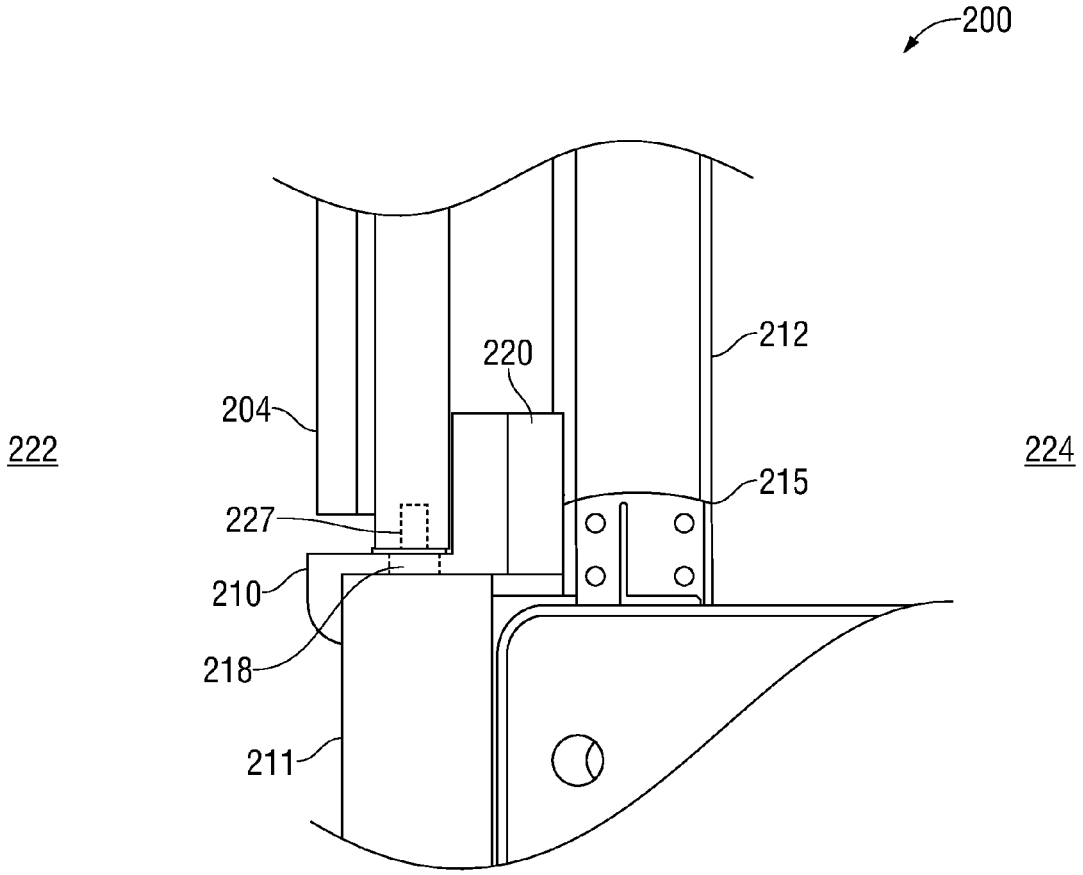
FIG. 2E is a close-up view of a bottom rail of the exemplary refrigerated enclosure system of FIG. 2B.

FIG. 2E is a close-up view of the bottom rail 210 of the exemplary refrigerated enclosure system 200 from FIG. 2B. For illustrative purposes, FIG. 2E will be described herein relative to FIG. 2B. The bottom rail 210 is shown attached to a top side of the bottom portion 211. The door 204 is shown secured to the bottom rail 210 via a pin 227 that is inserted into the hinge mount 218. As can be seen in FIG. 2E, the bottom rail 210 has a similar cross-section compared to the top rail 208, but the bottom rail 210 is flipped upside-down. In some embodiments, the top rail 208 and the bottom rail 210 may be manufactured as the same part. At the time of installation, the part may be secured as either a top rail 208 or a bottom rail 210 as appropriate.

Figure 2F:
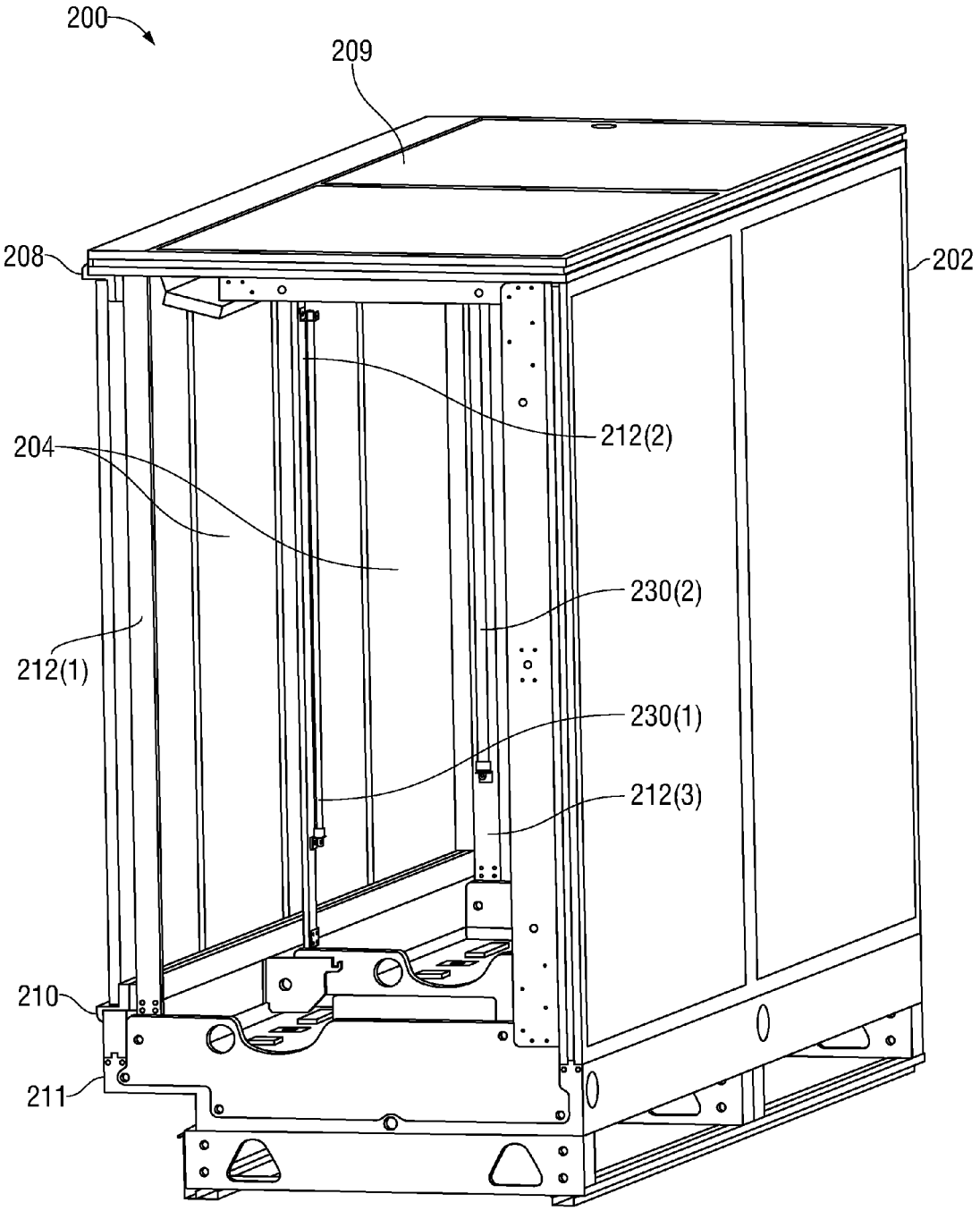
FIG. 2F is a perspective view of an inside of the exemplary refrigerated enclosure system illustrating an installed lighting system.

FIG. 2F is a perspective view of an inside of the exemplary refrigerated enclosure system 200 illustrating an installed lighting system 230. As shown in FIG. 2F, multiple lighting systems 230(1)-(2) are installed. A lighting system 230(1) is attached to a vertical rail 212(1) and a lighting system 230(2) is attached to a vertical rail 212(2). In other embodiments, more or fewer lighting systems 230 may be secured throughout the refrigerated enclosure system 230 to provide the desired lighting to the refrigerated enclosure system 230.

Conditional language used herein such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A refrigerated enclosure system comprising:

an enclosure comprising an interior region defined between a top portion and a bottom portion;

a top rail attached to the top portion, wherein the top rail comprises a first mounting face and an upper hinge mount;

a bottom rail attached to the bottom portion, wherein the bottom rail comprises a second mounting face and a lower hinge mount;

wherein a central axis of the lower hinge mount is positioned relative to a central axis of the upper hinge mount to enable a door secured to the upper hinge mount and the lower hinge mount to open and close relative to an opening of the enclosure;

a first insulating layer positioned on a back side of the top rail and within the interior region;

a second insulating layer positioned on a back side of the bottom rail and within the interior region;

wherein the first and second insulating layers inhibit a transfer of heat into the enclosure; and wherein the upper and lower hinge mounts comprise a recess formed through the first and second mounting faces, respectively.

2. The refrigerated enclosure system of claim 1, comprising:

a vertical support attached at a first end to the top portion of the enclosure and at a second end at the bottom portion of the enclosure; and wherein the vertical support is disposed within the interior region of the enclosure.

3. The refrigerated enclosure system of claim 2, comprising a lighting system secured to the vertical support.

4. The refrigerated enclosure system of claim 2, wherein the top rail, the bottom rail, and the vertical support eliminate a need for a frame to which the door is attached.

5. The refrigerated enclosure system of claim 1, comprising:

a light rail secured to the top portion of the enclosure; and a lighting system secured to the light rail.

6. The refrigerated enclosure system of claim 1, comprising a cold-air vent system, the cold-air vent system comprising:

a header portion coupled to the top portion of the enclosure to allow cold air from the interior region to be communicated into the header portion; and a vent coupled to the header portion to communicate the cold air to an area in front of the enclosure.

7. The refrigerated enclosure system of claim 1, comprising a plurality of shelves disposed within the interior region and adapted to store and display a plurality of products.

8. The refrigerated enclosure system of claim 1, wherein the first and second insulating layers comprise U-Values of 0.460 BTU/hr-ft$^2$-° F. or lower.

9. A door-mounting system comprising:

a top rail securable to an upper portion of a structure, the top rail comprising a first mounting face oriented downwards and a first hinge mount associated with the first mounting face;

a bottom rail securable to a lower portion of the structure, the bottom rail comprising a second mounting face oriented upwards towards the first mounting face and a second hinge mount associated with the second mounting face;

wherein a central axis of the second hinge mount is positioned relative to a central axis the first hinge mount to enable a door secured to the first hinge mount and the second hinge mount to pivot relative to the top rail and the bottom rail;

a first insulating layer positioned on a back side of the top rail;

a second insulating layer positioned on a back side of the bottom rail;

wherein the first and second insulating layers inhibit heat transfer from an area in front of the top rail and the bottom rail to an area behind the top and the bottom rail; and wherein the first and second hinge mounts comprise a recess formed through the first and second mounting faces, respectively.

10. The door-mounting system of claim 9, wherein the structure is a refrigerated enclosure.

11. The door-mounting system of claim 9, comprising a vertical support attached at a first end to the upper portion of the structure and at a second end to the lower portion of the structure, and wherein the vertical support is disposed within an interior region of the structure.

12. The door-mounting system of claim 11, comprising a lighting system secured to the vertical support.

13. The door-mounting system of claim 9, comprising:

a bracket secured to the back side of the top rail; and a lighting system secured to the bracket.

14. The door-mounting system of claim 9, comprising:

a bracket secured to the back side of the bottom rail; and a lighting system secured to the bracket.

15. The door-mounting system of claim 9, comprising a cold-air vent system comprising:

a header portion that is coupled to the upper portion of the structure to allow cold air from an interior region of the structure to be communicated into the header portion; and a vent that is coupled to the header portion to communicate the cold air to an area in front of the structure.

16. The door-mounting system of claim 9, wherein the first and second insulating layers comprise U-Values of 0.460 BTU/hr-ft$^2$-° F. or lower.

17. A door-mounting system comprising:

a top rail securable to an upper portion of a structure, the top rail comprising a first mounting face oriented downwards and a first hinge mount associated with the first mounting face;

a bracket secured to a back side of the top rail;

a lighting system secured to the bracket a bottom rail securable to a lower portion of the structure, the bottom rail comprising a second mounting face oriented upwards towards the first mounting face and a second hinge mount associated with the second mounting face; and wherein a central axis of the second hinge mount is positioned relative to a central axis the first hinge mount to enable a door secured to the first hinge mount and the second hinge mount to pivot relative to the top rail and the bottom rail.

* * * * *